United States Patent [19]

Beasley

[11] Patent Number: 4,509,744

[45] Date of Patent: Apr. 9, 1985

[54] AQUATIC EXERCISE DEVICE WITH RIGID FLUID RESISTANCE MEMBER

[76] Inventor: Robert L. Beasley, 1217 Terra Mar Dr., Tampa, Fla. 33612

[21] Appl. No.: 594,463

[22] Filed: Mar. 28, 1984

Related U.S. Application Data

[63] Continuation of Ser. No. 384,720, Jun. 3, 1982, abandoned.

[51] Int. Cl.[3] ..... A63B 69/12; A63B 31/10

[52] U.S. Cl. ..... 272/116; 272/71; 272/143; 441/58

[58] Field of Search ..... 272/54, 62, 71, 93, 272/112, 116, 117, 119, 130, 143; 441/56, 57, 58, 59; 16/111 R, 115, 125; D21/238, 239; 172/370; 124/20 R, 21, 22

[56] References Cited

U.S. PATENT DOCUMENTS

| | | | |
|---|---|---|---|
| D. 196,689 | 10/1963 | O'Reilly | D21/239 |
| 846,995 | 3/1907 | Greeley | 16/111 R X |
| 1,062,587 | 5/1913 | Goersch | 441/58 |
| 1,546,670 | 7/1925 | O'Sullivan | 441/58 |
| 1,715,571 | 6/1929 | Robertson | 441/58 |
| 1,754,704 | 4/1930 | Wilcox | 441/58 |
| 2,389,196 | 11/1945 | Harmon | 441/58 |
| 2,853,992 | 9/1958 | Wheeler | 124/22 |
| 3,146,470 | 9/1964 | Hamblin | 441/58 |
| 4,109,908 | 8/1978 | Pugh et al. | 272/119 |

FOREIGN PATENT DOCUMENTS

| | | | |
|---|---|---|---|
| 835848 | 10/1938 | France | 441/58 |

*Primary Examiner*—Richard T. Stouffer
*Attorney, Agent, or Firm*—Arthur W. Fisher, III

[57] ABSTRACT

An aquatic exercise device for use in a swimming pool or the like comprising a substantially rectangular, flat rigid fluid resistance member having an adjustable substantially U-shaped hand gripping member disposed in fixed spaced relation relative to the surface of the substantially rectangular flat rigid fluid resistance member by a pair of substantially parallel interconnecting members and a wrist guide including a flat rigid stability member extending in a coplanar relation relative to the substantially rectangular flat rigid fluid resistance member to engage the user's wrist and a substantially J-shaped axial alignment member extending from one longitudinal edge of flat rigid stability member to receive the user's wrist such that the user grasps the adjustable substantially U-shaped hand gripping member while placing his wrist within the substantially J-shaped axial alignment member whereby the user moves the aquatic exercise device through the water to create a significant resistance on the substantially rectangular flat rigid fluid resistance member to exercise the user.

9 Claims, 2 Drawing Figures

AQUATIC EXERCISE DEVICE WITH RIGID FLUID RESISTANCE MEMBER

This application is a continuation of U.S. application Ser. No. 384,720, filed June 3, 1982, now abandoned.

BACKGROUND OF THE INVENTION

1. Field of the Invention

An aquatic exercise device for use in a swimming pool or the like comprising a handheld fluid resistance member whereby the user moves the aquatic exercise device through the water to create a significant resistance.

2. Description of the Prior Art

A number of exercise devices have been developed to use isotonic, isokinetic or isomeric exercises.

The user of weights or spring units individually or in association with mechanical devices have been employed in conditioning and developing the human body.

Swimming has also been found to be an excellent form of exercise. In swimming, the fluid resistance offers a load to strengthen and condition the body.

The effectiveness and efficiency of the water resistance can be greatly enhanced through the use of a resistance member held by the user as the user's arms are moved through the water.

Examples of the prior art are found in U.S. Pat. Nos. 3,517,930; 3,786,526, and 3,913,907.

SUMMARY OF THE INVENTION

The present invention relates to an aquatic exercise device for use in a swimming pool or the like comprising a fluid resistance member and wrist guide.

The fluid resistance member comprises a substantially rectangular flat rigid fluid resistance member having an adjustable substantially U-shaped hand gripping member.

The wrist guide comprises a flat rigid stability member extending in coplanar relation relative to the substantially rectangular flat rigid fluid resistance member and a substantially J-shaped axial alignment member to maintain axial alignment between the user's arm and the substantially rectangular flat rigid fluid resistance member.

In use, the user graps the adjustable substantially U-shaped hand gripping member while placing his wrist within the substantially J-shaped wrist guide. The user than moves the aquatic exercise device through the water creating a significant resistance to strengthen and condition the user.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The exercise device of the present invention is intended to be useful for two primary purposes. That is, an exercise device for strengthening and conditioning the muscles and body utilizing isokinetic principles and a sports skill training device whereby specific movement patterns can be duplicated against resistance, thus developing neuromuscular coordination as well as power and strength. Thus, the exercise device permits complete, full-range isokinetic exercise and kinesthetic (neuromuscular awareness) training for virtually unlimited variations of angular movements of the arms, shoulders, chest and back due to the specific design and construction of the resistance member, handle and wrist guide as exemplified below.

Figure 1:
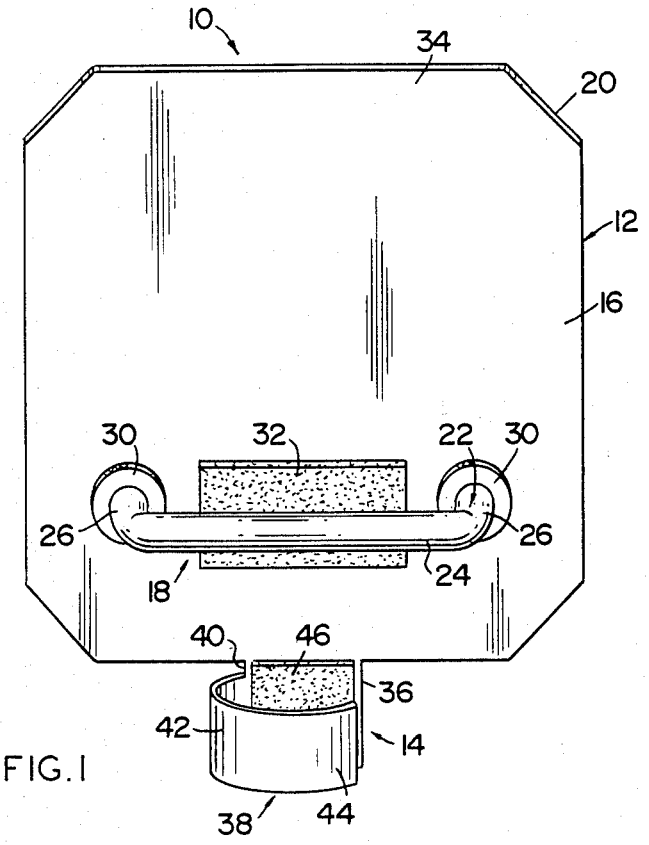
FIG. 1 is a top view of the aquatic exercise device.
Figure 2:
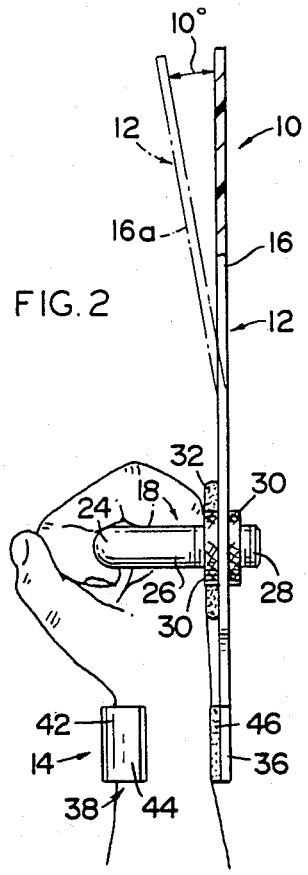
FIG. 2 is a side view of the aquatic exercise device.

Specifically, as shown in FIGS. 1 and 2, the present invention relates to an aquatic exercise device generally indicated as 10 for use in a swimming pool or the like. The aquatic exercise device 10 comprises a fluid resistance member and wrist guide generally indicated as 12 and 14 respectively.

The fluid resistance member 12 comprises a substantially rectangular flat rigid fluid resistance member 16 having an adjustable substantially U-shaped hand gripping member generally indicated as 18 attached thereto. Alternately, the rigid fluid resistance member 16 may include an inclined element **16*a* (phantom line of FIG. 2) of approximately 10°. The corners 20 are formed as diagonal edges between adjacent sides while a pair of apertures 22 are formed in the rear portion of the substantially rectangular flat rigid fluid resistance member 16 to receive the adjustable substantially U-shaped hand gripping member 18 as more fully hereinafter. The adjustable substantially U-shaped hand gripping member 18 comprises a hand grip 24 held in fixed spaced relation relative to the substantially rectangular flat rigid fluid resistance member 16 by a pair of substantially parallel interconnecting members each indicated as 26. The lower portion of each interconnecting members 26 includes threads 28 to receive fasteners or lock nuts 30 disposed on opposite sides of the substantially rectangular flat rigid fluid resistance member 16. A resilient pad 32 is attached to the upper surface 34 of the substantially rectangular flat rigid fluid resistance member 16 between the pair of substantially parallel interconnecting members 26**.

The wrist guide 14 comprises a flat rigid stability member 36 extending in coplanar relation relative to the substantially rectangular flat rigid resistance member 16 to engage the user's wrist and a substantially J-shaped axial alignment member generally indicated as 38 extending from one longitudinal edge 40 of the flat rigid stability member 36 to maintain axial alignment between the user's arm and the substantially rectangular flat rigid fluid resistance member 16. The substantially J-shaped axial alignment member 38 comprises a substantially arcuate interconnecting member 42 extending outwardly from the longitudinal edge 40 and retainer element 44 in substantially parallel relation relative to the flat rigid stability member 36. A resilient pad 46 is formed on the surface of the flat rigid stability member 36.

In use, the user grasps the hand grip 24 either as shown or by reversing the grip and placing his wrist within the wrist guide 14. In either disposition, the wrist rests against the flat rigid stability member 36 to reduce the turning moment about the wrist. The substantially J-shaped axial alignment member 38 reduced the movement of the substantially rectangular flat rigid fluid resistance member 16 during use.

Thus it is observed that the placement of an "elevated", and upward-downward adjustable U-shaped handle permits actual grasping of the handle bar in either a supinated (palms forward) or pronated (palms backward) position. This feature allows the user to "pull" or "push" the resistance member, thus duplicating traditional dumbbell-type weight training movements. In addition, since the exercise is performed in the relatively gravity free water medium, yet against the resistance of the water itself, an unlimited array of resistive angular movements in all planes and combination of planes is possible.

Moreover, adjustment of the handle upward and downward in relation to the flat resistance member permits greater, or lesser, wrist flexion and extension, such as is desirable in executing throwing patterns and/or striking movements in other sports such as the golf swing, the racquetball or handball strike, or the baseball throw. Handle adjustment also permits the use of two hands in an overlapping grip so that the striking patterns of baseball, golf and the two-handed tennis stroke can be emulated.

The size and shape of the resistance member closely approximates the size and shape of the striking surfaces of tennis and racquetball racquets. When used in the water the user can replicate a forehand or backhand stroke while grasping the U-shaped handle and pulling or pushing the resistance member through the water creating a resistance to strokes. The shape and surface of the resistance member is also important as a stroke pattern developer (neuromuscular skill).

The flat, rigid, fluid resistant member substantially reduces wrist flexion and extension when performing the forehand and backhand tennis stroke (a common error) and distributes resistance against the appropriate muscularture used in the strokes. The retainer element of the wrist guide ensures perpendicular alignment of the resistance member as it is passed through the water.

The open side of the retainer element was specifically designed to permit rapid and easy exit from the device, a very important feature for safety purposes. This feature also facilitates rapid changes from the supinated to pronated (and vice versa) hand grip position.

As can be observed, the specific combination of the handle, the shape and surface area of the resistance member, the rigid, fluid resistant writs member, and the axial alignment member act in concert to provide kinesthetic training, as well as muscular strength and power training.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. An aquatic exercise device for use in a swimming pool or the like comprising a rigid fluid resistance member including a substantially planar inner portion having a wrist guide extending outwardly from the periphery of said substantially planar inner portion and a hand grip held in fixed spaced relation relative to said substantially planar inner portion by a pair of interconnecting members, said wrist guide comprising a wrist stabilizing member extending outwardly from said rigid fluid resistance member to engage the user's wrist, said wrist stabilizing member comprising a substantially U-shaped member, the legs of said U-shaped member extending substantially parallel to the plane defined by said planar inner portion of said rigid fluid resistance member and also to said hand grip to engage opposite sides of the user's wrist joint to retain the user's wrist rigidly therein such that the user grasps said hand grip while placing his wrist within said wrist guide to prevent flexure and extension of the user's wrist as the user moves said aquatic exercise device through the water creating a resistance on said rigid fluid resistance member to exercise the user.

2. The aquatic exercies device of claim 1 further including a resilient pad attached to the surface of said rigid fluid resistance member between said pair of interconnecting members to engage the back of the user's hand and a resilient pad attached to the inner surface of said substantially U-shaped member to engage the back of the user's wrist.

3. The aquatic exercise device of claim 1 wherein said rigid fluid resistance member includes a pair of apertures formed therein to receive the lower portions of said pair of interconnecting members therethrough, said lower portions being threaded and receiving fasteners thereon to permit selective adjustment of said hand grip vertically relative to said rigid fluid resistance member.

4. The aquatic exercise device of claim 3 wherein said fasteners comprise a pair of lock nuts disposed on opposite sides of said rigid fluid resistance member.

5. The aquatic exercise device of claim 1 wherein said rigid fluid resistance member is substantially flat.

6. The aquatic exercise device of claim 5 wherein said substantially flat rigid fluid resistance member is substantially square in configuration.

7. The aquatic exercise device of claim 6 wherein the corners of said substantially square flat rigid fluid resistance member are substantially diagonal.

8. The aquatic exercise device of claim 1 wherein said pair of interconnecting members are substantially parallel relative to each other.

9. The aquatic exercise device of claim 1 wherein said rigid fluid resistance member includes an inclined outer portion disposed at substantially 10° to said substantially planar inner portion.

* * * * *